United States Patent [19]

Horton

[11] Patent Number: 4,511,287

[45] Date of Patent: Apr. 16, 1985

[54] SUBMERGED BUOYANT OFFSHORE DRILLING AND PRODUCTION TOWER

[75] Inventor: Edward E. Horton, Rancho Palos Verdes, Calif.

[73] Assignee: Global Marine, Inc., Los Angeles, Calif.

[21] Appl. No.: 335,886

[22] Filed: Dec. 30, 1981

Related U.S. Application Data

[63] Continuation-in-part of Ser. No. 146,362, May 2, 1980, abandoned.

[51] Int. Cl.[3] ..... E02B 17/00

[52] U.S. Cl. ..... 405/204; 405/195; 405/205

[58] Field of Search ..... 405/169, 170, 191, 195, 405/202–207, 209, 225; 166/350, 367; 175/5, 8

[56] References Cited

U.S. PATENT DOCUMENTS

| | | | |
|---|---|---|---|
| 3,017,934 | 1/1962 | Rhodes et al. | 166/350 |
| 3,166,123 | 1/1965 | Watkins | 405/191 X |
| 3,378,067 | 4/1968 | Leonard et al. | 166/350 |
| 3,381,482 | 5/1968 | Manning | 405/204 |
| 3,387,459 | 6/1968 | Manning | 405/205 |
| 3,395,755 | 8/1968 | Manning | 175/8 X |
| 3,782,460 | 1/1974 | Skinner | 166/350 X |
| 4,094,162 | 6/1978 | Allee | 405/204 |
| 4,100,752 | 7/1978 | Tucker | 405/202 X |
| 4,109,478 | 8/1978 | Gracia | 405/195 |
| 4,167,279 | 9/1979 | Lucksinger | 166/350 X |
| 4,182,584 | 1/1980 | Panicker et al. | 405/195 |
| 4,188,156 | 2/1980 | Fisher et al. | 405/195 |
| 4,231,682 | 11/1980 | Tuson | 405/202 |
| 4,256,417 | 3/1981 | Bohannon | 405/195 |

*Primary Examiner*—David H. Corbin

*Attorney, Agent, or Firm*—Christie, Parker & Hale

[57] ABSTRACT

A submerged tubular tower 10 is connected at its lower end 15 to an ocean floor 11 at a site where at least one subsea hydrocarbon well is to be drilled. A riser duct 22 for each well to be drilled extends from an upwardly accessible connection point 20 at the upper end 14 of the tower to the lower end of the tower. The tower is positively buoyant to stand erect in an unguyed manner. The upper end of the tower is located a substantial distance above the ocean floor at a depth sufficiently small to enable wells to be drilled through the riser ducts, through equipment 19 landed on the top of the tower, using floating drilling equipment 12 designed for use in substantially shallower water depths.

31 Claims, 18 Drawing Figures

12
13
19
14
18
10
17
16
15
11

Fig. 11
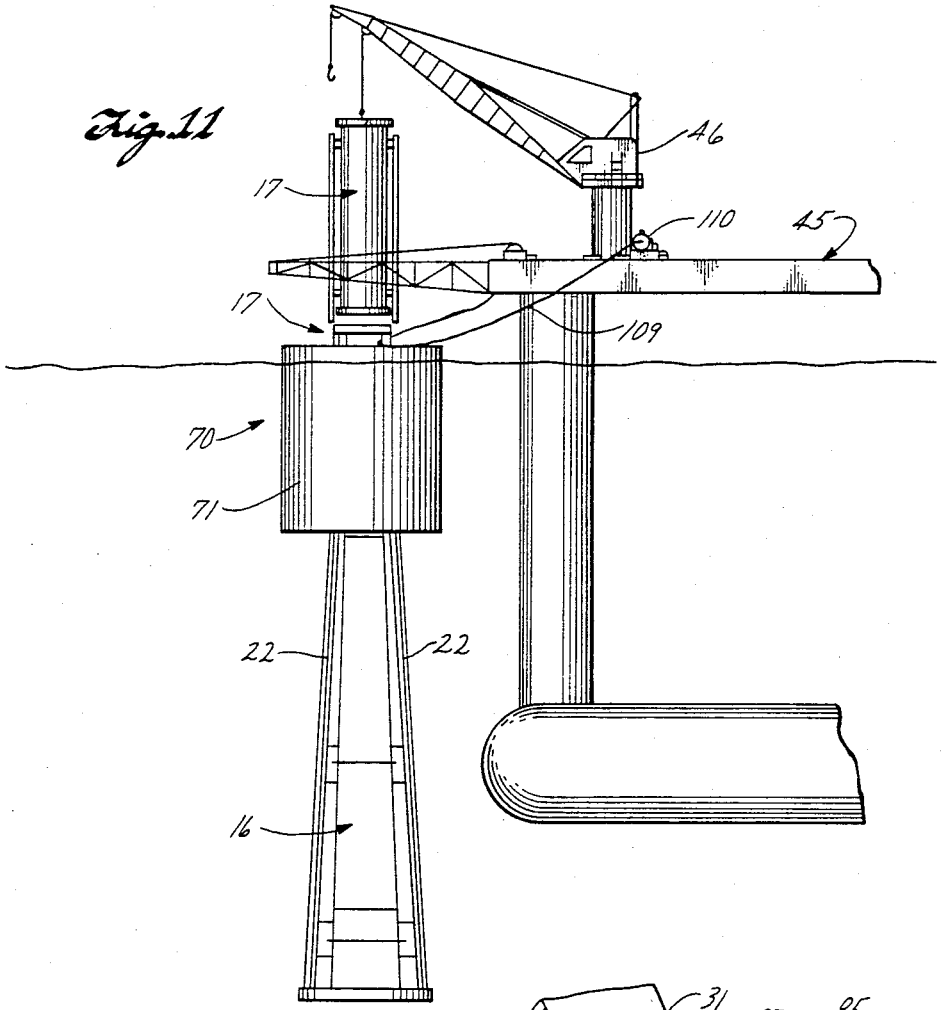
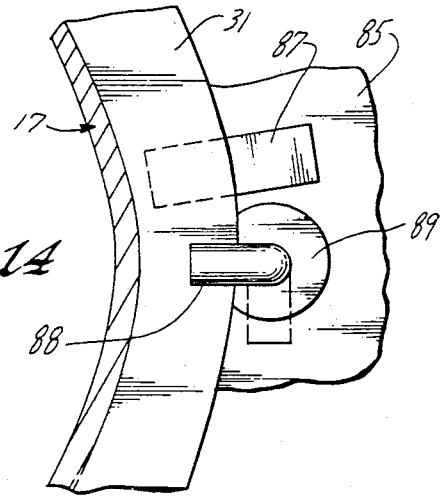
Fig. 14

70
17
31
32
83
84
17
75
80
74
72
31
73
71
82
32
17

17
71
77
76
75
31
88
89
86
79
32
87
81
85
78
10
81
79
17
80
72
10

104
94
107
32
107
105
112
106
105
102
106
10
101
103
108
101
108
97
100

SUBMERGED BUOYANT OFFSHORE DRILLING AND PRODUCTION TOWER

This application is a continuation-in-part of application Ser. No. 146,362, filed May 2, 1980, now abandoned.

FIELD OF THE INVENTION

This invention pertains to the drilling of offshore hydrocarbons wells and to the production of hydrocarbons from such wells. More particularly, it pertains to apparatus and procedures enabling such wells to be drilled and produced in water of great depth using equipment designed for use in significantly shallower waters.

BACKGROUND OF THE INVENTION

Review of the Prior Art

Substantial reserves of hydrocarbons, i.e., oil and gas, are known to lie beneath the floors of the oceans of the world. Many of these reserves lie under shallow waters, as under continental shelves relatively close to shore. Much equipment and various procedures have been developed over the years at great cost to tap these shallow-water reserves. There is presently a significant worldwide inventory of equipment useful to drill wells in shallow waters and to produce oil and gas from such wells. Production equipment for use with offshore wells most commonly involves a tower or platform erected on the ocean floor and extending to above the ocean surface.

Shallow water oil and gas reserves are being depleted steadily. The search for offshore oil and gas is moving into deeper and deeper water farther and farther from shore. Substantial reserves have been located under waters 1000 feet (303 meters) or more in depth. Such depths are beyond the economic threshold of development, assuming the use of existing equipment and procedures designed and created for use in shallower waters; in some instances, newly discovered subsea hydrocarbons reserves are under waters of such great depth as to be beyond the limits of present technology, irrespective of cost.

Rigid bottom-supported structures, such as have been developed for use in the North Sea, are extremely expensive; their costs increase exponentially with increased water depth. The use of existing technology and equipment is presently limited to waters somewhat over 1000 feet (303 meters) deep or less.

Current known efforts to design hydrocarbons production systems for use in deep water (i.e., waters deeper than about 1000 feet or about 300 meters) focus predominantly upon the use of subsea completion systems which involve expensive and untested (in terms of reliability) control equipment on the sea floor. In deep water, such equipment is costly and often hazardous to maintain.

It is thus apparent that a need exists for new technology, equipment and procedures effective at reasonable cost to develop and produce subsea hydrocarbons reserves lying under waters 1000 feet (303 meters) or more in depth.

SUMMARY OF THE INVENTION

This invention addresses the need identified above. It provides equipment and procedures which enable offshore reserves of hydrocarbons lying under waters of great depth to be developed and produced by substantial use of available equipment and techniques originally developed for use in much shallower waters. The invention thus takes maximum technical and economic advantage of the present inventory of offshore drilling and production technology and relies minimally upon wholly new, costly and unproven technology. In a sense, this invention enables the sea floor to be raised from great depths to a depth sufficiently close to the water surface to enable existing floating equipment, originally designed and perfected for shallow waters, to be used effectively, safely and economically in water depths now beyond their capability.

Generally speaking, this invention provides apparatus useful for defining, at an offshore location in an ocean and the like, in water of substantial depth, a submerged installation which provides a connection point for the drilling of a subsea hydrocarbons well by use of drilling equipment normally useful only in waters of substantially shallower depth. The finished installation comprises an elongate, slender, unguyed, positively buoyant, erect tower structure which extends from a lower end at the ocean floor to an upper end disposed at a selected depth below the water surface. The apparatus according to this invention comprises a tubular tower lower section defining, at a lower end thereof, means adapted for the connection of the section to the ocean floor and for holding the section from upward movement when subjected to substantial upwardly directed force. The lower section has an upper end adapted to mate coaxially with and to be secured to a lower end of one of a plurality of tower structure central sections. The inventive apparatus also includes a tubular tower upper section having a lower end adapted to mate coaxially with and be secured to an upper end of one of the tower central sections. The upper section has an upper end which defines at least one connection point for the drilling of a subsea hydrocarbons well. The connection point is arranged for access thereto and for selection of selected equipment thereto from above. A plurality of tower structure tubular central sections are also provided. Each central section is adapted, at upper and lower ends thereof, to mate coaxially with and to be secured to the lower and upper ends of others of the central sections, or to the upper end of the lower section or to the lower end of the upper section, as appropriate. The central sections are sufficient in number and aggregate length that when the central sections are connected in series between the lower and upper sections of the tower, there results a tower structure having a length equal to the distance between the selected water depth and the ocean floor at the desired offshore location. At least one tubular riser duct section defined in the completed tower structure in a selected position relative to the tower structure. At least some, if not all, of the tower sections are arranged to cooperate with the riser ducts to hold them in desired position laterally, and in some cases vertically, relative to the tower section. There are the same number of riser ducts as there are connection points defined at the upper end of the tower upper section. Each riser duct has its upper end connected to the respective connection point. Buoyancy means are provided within the upper section and within at least some of the other tower sections. The buoyancy means are operable for rendering the corresponding tower sections positively buoyant. Upon connection of the serially interconnected tower sections and upon to the ocean floor, and upon installation of the riser ducts in the tower, there results a submerged tower as aforesaid which includes a riser duct extending along the tower from each connection point to the lower end of the tower.

DESCRIPTION OF THE ACCOMPANYING DRAWINGS

The above-mentioned and other features of this invention are more fully set forth in the following description of a presently preferred embodiment of this invention, such description being presented with reference to the accompanying drawings, wherein:

FIG. 11 is an elevation view illustrating the use of an auxiliary floatation structure in the course of assembling the tower;

FIG. 14 is a top plan view of certain of the structure shown in FIG. 13;

DESCRIPTION OF THE ILLUSTRATED EMBODIMENT

Figure 1:
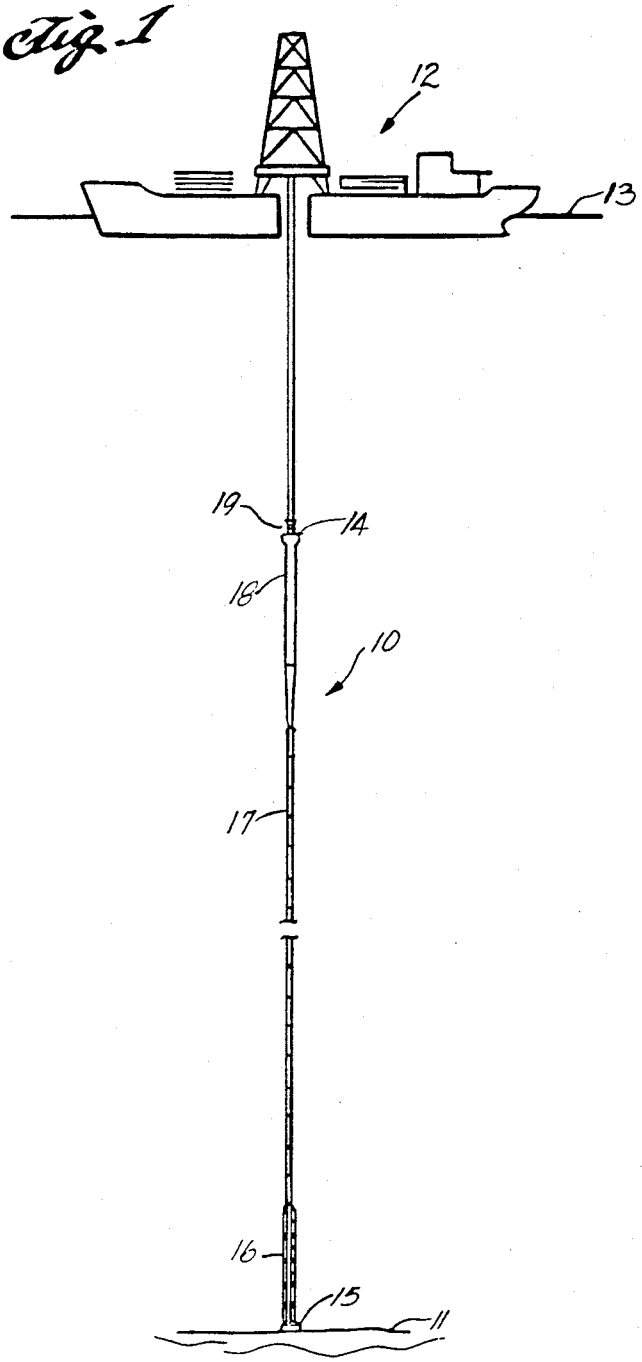
FIG. 1 is an elevation view showing the drilling of a subsea oil or gas well from a floating drilling vessel by use of a submerged tower structure according to this invention.

A slender, elongate, tubular, submerged tower 10 according to this invention is shown in FIG. 1 in use in the course of drilling a subsea oil or gas well in a geological formation lying below an ocean floor 11. The well is drilled by use of a drilling platform such as a drillship 12, floating on the ocean surface 13. The water depth below drillship 12 may be on the order of 1000 feet (303 meters) or more, say, 12,000 feet (3636 meters). The tower has an upper end 14 disposed a selected distance, say 300 feet (90 meters), below ocean surface 13, and has a lower end 15 secured to the ocean floor. The distance between the water surface and the upper end 14 of tower 10 is sufficiently great to cause the upper end of the tower to be substantially below the range at which the dynamic effects of surface waves will have significant effect upon the tower, yet such distance is sufficiently low that equipment and procedures developed and useful in drilling subsea wells in substantially shallower depths, such as 300 foot (90 meter) water depths, can be used to advantage. In effect, the function of tower 10 is to artificially raise the ocean floor from an actual depth at the location of the lower end of the tower to an apparent depth corresponding to the upper end of the tower.

Tower 10 is composed of a series of components of modular nature which are prefabricated at a suitable onshore location, and then are brought to the offshore location at which the tower is to be installed. At the offshore location the tower components are assembled in serial order and are lowered into secure connection with ocean floor 11. The components of the tower include a lower section 16 (see FIG. 2), an appropriate plurality of essentially identical central sections 17 (see FIG. 4), and an upper section 18 (see FIG. 5).

As shown in FIG. 1, when the several sections of the tower are interconnected in serial order and the assembled structure is secured to the ocean floor, there results an elongate, positively buoyant, unguyed, tubular tower which has a high slenderness ratio so that the tower is compliant to, rather than resistant to, environmental loads such as ocean currents and lateral drag forces applied to the tower by such currents. By reason of its positively buoyant characteristics, the principal design considerations which apply to the tower are those of axial tensile loading and transverse bending moment. Considerations involving compressive loads on columns are not relevant to the effective design of tower 10.

As installed on ocean floor 11, tower 10 provides at least one, and preferably a plurality of riser ducts 22 (see FIG. 4, e.g.) which extend along the entire length of the tower, preferably principally externally of the tower structure per se. The riser ducts extend from connection points 20 (see FIG. 5) accessible from above at the upper end of the tower to lower ends at the lower end of the tower. The connection points are capable of receiving and mating with conventional subsea drilling equipment, such as a blowout preventer shown generally at 19 in FIG. 1 and in more detail in FIG. 5. Each connection point 20 preferably has the structure and configuration of a landing stump such as is typically included in a landing base used in drilling offshore oil and gas wells in water depths of 300 feet or so.

Figure 2:
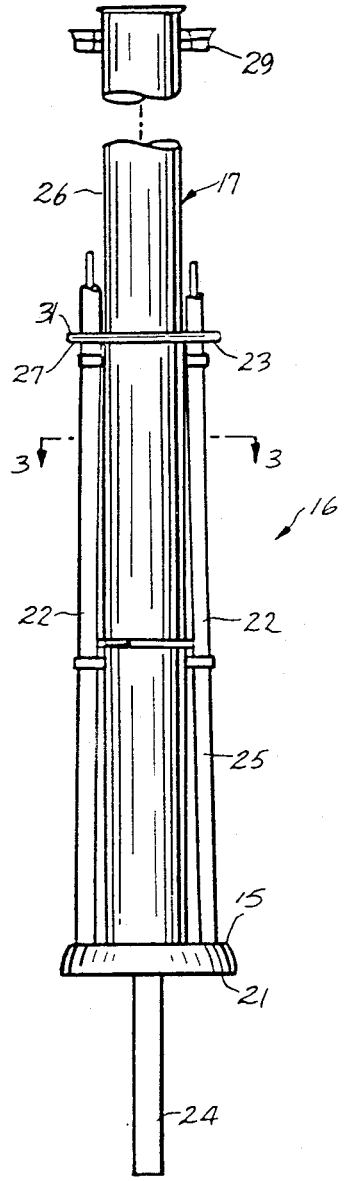
FIG. 2 is an elevation view of the lower section of the tower shown in FIG. 1.
Figure 4:
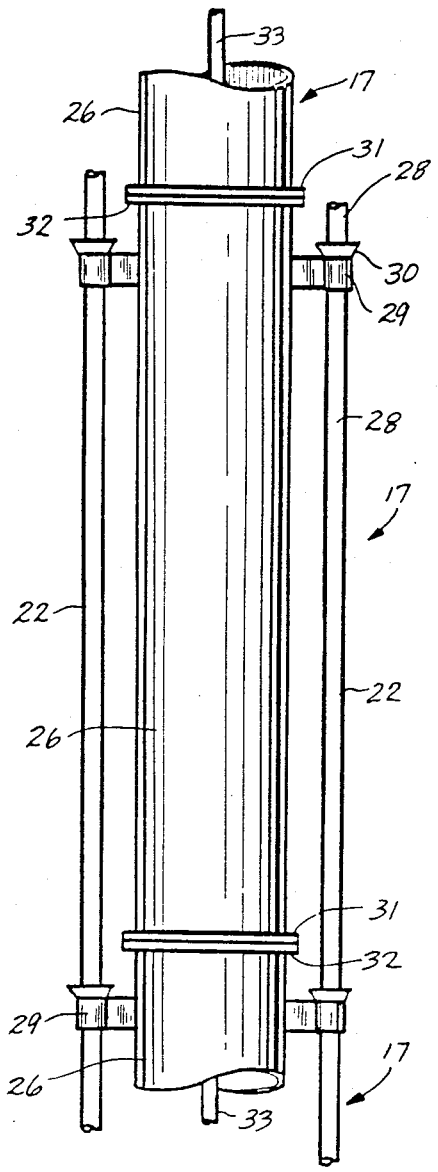
FIG. 4 is an elevation view of a tower central section shown connected between two adjacent central sections in the tower as illustrated in FIG. 1.

Tower lower section 16 (see FIG. 2) is prefabricated as a unit having a length substantially greater than the fabricated length of any of the modular central sections 17 shown in FIG. 4; as shown in FIG. 2, the tower lower section may have a fabricated length on the order of 100 feet (30 meters) or so. The lower section has a lower end corresponding to tower lower end 15 which is defined by a base structure 21 which defines a hollow housing at the lower end of the tower. Within the interior of base structure 21, in association with the lower ends of corresponding riser duct sections 22, are located suitable structures from which appropriate lengths of different diameter surface casing may be hung off from the base structure in the course of drilling oil or gas wells in ocean floor 11 through the riser ducts. The riser ducts have upper ends connected to connection points 20 at the upper end of the tower; see FIG. 5. The tower lower section above base structure 21 is of decreasing diameter proceeding upwardly along the lower section to its upper end 23 where the lower section defines a component 27 of a connector adapted to mate coaxially with and to be secured to a lower end of one of tower central sections 17.

Also, at its lower end, the tower lower section carries means which adapt the tower, and the lower section thereof, for connection to ocean floor 11 sufficiently securely to enable the tower, when completed and rendered maximally positively buoyant, to be held from upward movement away from the ocean floor. For purposes which will become apparent from the following description, in the case of tower 10 as illustrated in the accompanying drawings, the mechanism used to secure the tower to the ocean floor is an elongate hollow tubular grouting stub assembly 24 which is open at its lower end. The grouting stub assembly may have a length on the order of 30–40 feet and may have a diameter of 5–6 feet, as desired.

The tubular body 25 of the tower lower section may have a diameter on the order of 15–18 feet (3.64–5.45 meters) at its lower end and a diameter on the order of 14 feet (4.24 meters) or so at its upper end equal to the uniform diameter of the body 26 of any of the essentially identical tower central sections 17.

Figure 3:
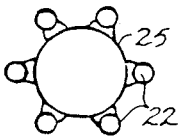
FIG. 3 is a cross-section view taken along line 3—3 in FIG. 2.

As shown in FIG. 3, in tower 10 there are six riser ducts 22 disposed externally of the tower body to extend parallel to the length of the tower at equally spaced intervals about the circumference of the tower.

Figure 5:
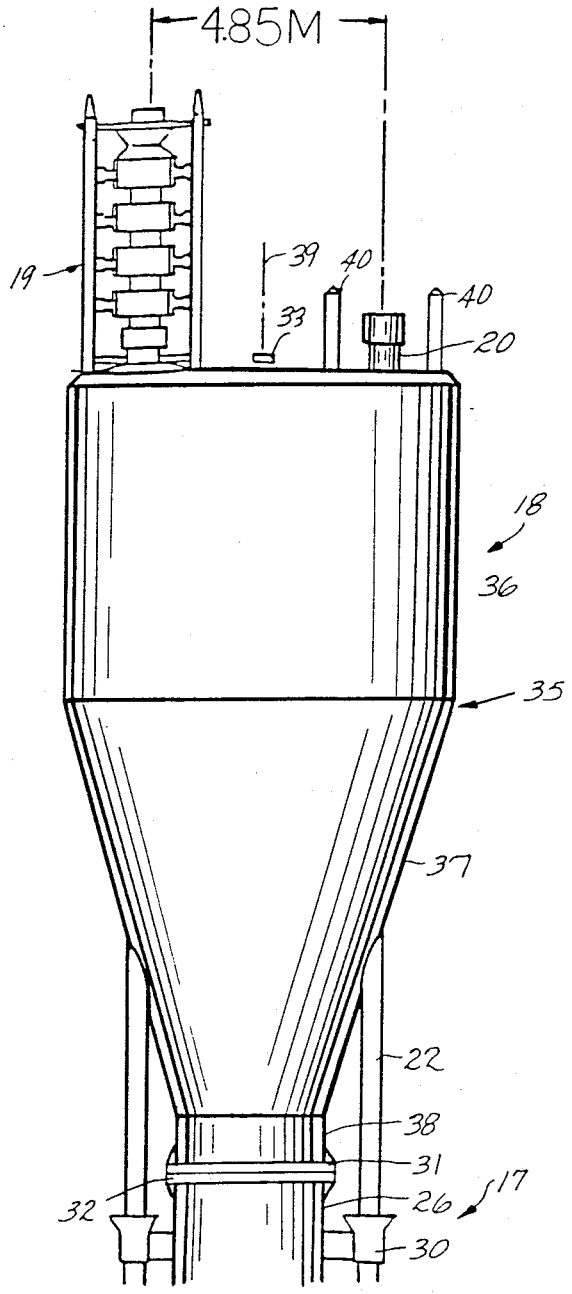
FIG. 5 is an elevation view of the upper section of the tower shown in FIG. 1.

One of the several tower central sections 17 is shown in FIG. 4 as installed in the finished tower in end-to-end relation with coaxially aligned adjacent central sections. The several tower central sections are essentially identical and are comprised principally of an elongate tubular body 26 and a number of sections of riser ducts 22; there are the same number of riser duct sections associated with each tower section as there are well connection points 20 defined at the upper end of the tower. If the tower is to be used to drill a single well in ocean floor 11, the riser duct may be defined coaxially within the tower. However, if as preferred, and as shown in the accompanying drawings, the tower is to be used to drill a plurality of wells in ocean floor 11, the riser ducts are defined externally of the tower body over substantially the entirety of the length of the tower except in association with tower upper section 18 as shown in FIG. 5. As shown in FIG. 4 with reference to the tower central sections, it is preferred that each individual riser duct section 28 be carried at its upper end in a hanger structure 29 which extends radially outwardly from the upper exterior of the central section body 26. The upper end of each riser duct section is pendulously connected to a corresponding hanger structure to be secure from axial motion relative to the adjacent central section body. Each hanger structure defines an upwardly open guide funnel 30 for guiding the lower end of the riser duct section carried by the tower section next-above the hanger structure into registry, in a stab action manner, with the upper end of the riser duct section carried by the hanger structure. The lower end of each riser duct section 28 is configured to make a stab-type mating connection with the upper end of the riser duct section on another section of the tower. Preferably the connection between mated riser duct sections affords limited axial motion between the duct sections without impairment of continuity of fluid flow through the overall riser duct.

Each tower central section body 26 terminates at its lower end in a connector 31 and at its upper end in a connector 32. Connectors 31 and 32 are configured to mate and cooperate with each other for securing the tower central sections in coaxial alignment with each other. These connectors are also designed to hold against substantial upward loads applied to them. Each connector 32 is identical with connector 27 at the upper end of tower lower section 16.

The interior space of at least some of the bodies 26 of the tower central sections are arranged to define an airtight buoyancy chamber which extends substantially the entire length of the central section. Those central tower sections which define internal buoyancy chambers are equipped with buoyancy control means for controllably flooding and purging the respective buoyancy chamber, such means including controllable means for supplying compressed air to and venting air from the buoyancy chamber and controllable means for enabling water to flow into and out of the chambers, as desired. The buoyancy control means includes a suitable air supply, such as an air injection conduit 33 as shown in FIG. 4, and appropriate valves operable from remote locations or operable in response to the existence of predetermined local pressure differentials. As will be apparent from the following description, the buoyancy control means associated with the several buoyancy chambers provided in tower 10 are operable to establish three different buoyancy conditions in tower 10 at different times, in the course of its installation, namely:

(1) a condition of overall substantially neutral or slight positive buoyancy in the course of interconnection of the several tower sections in sequence, (2) a condition of overall negative buoyancy when the tower has been fully assembled, has been landed on ocean floor 11, and is in the course of being secured to the ocean floor, and (3) a condition of overall substantial positive buoyancy after the tower has been landed upon and secured to the ocean floor.

In all of these three overall buoyancy conditions, the center of buoyancy of the immersed tower structure is located in the tower substantially above the center of mass of the tower structure to assure that the tower itself always seeks a vertically erect attitude in the water.

The prefabricated modular sections of tower 10 include an upper section 18 shown in FIG. 5. Tower upper section 18 may have a prefabricated length on the order of 50 feet (15.2 meters), whereas the central sections may have a prefabricated length on the order of 40 feet (12.1 meters). As shown in FIG. 5, tower upper section 18 has a body 35 which is of substantially increased diameter relative to the body 26 of any of the tower central sections; the diameter of the tower central section bodies may be on the order of 14 feet (4.2 meters) whereas the diameter of the tower upper section may be on the order of 25 feet (7.6 meters). The tower body 35 preferably has a cylindrical upper portion 36 and an inverted frusto-conical central portion 37 connected to the lower end of body section 36 at its upper end and connected at its lower end to a body central portion 38 which has a diameter corresponding to the diameter of a tower central section body 26.

As noted above, there is defined externally of tower upper section 18 at its upper end at least one, and preferably a plurality of, connection points 20 for the drilling and production of a corresponding number of subsea wells which are to be drilled through tower 10 after installation of the assembled tower on ocean floor 11. Where a plurality of connection points are defined at the upper end of the tower, these connection points are defined at regularly spaced intervals around the circumference of a circle disposed concentrically of a tower axis 39; this circle may have a diameter of 16 feet (4.8 meters) as shown in FIG. 5. As noted above, each connection point is defined to have an external configuration similar to the configuration of a landing stump of the type regularly encountered in landing bases for shallow water subsea wells. Also, there are preferably provided, in association with each connection point, a pair of upwardly extending guide posts 40 in predetermined spaced relation to the corresponding connection point. The guide posts enable subsea drilling and production equipment to be guided into registry with each connection point 20 according to procedures well known in the art pertinent to the drilling of shallow water subsea wells.

Tower upper section 18 also includes for each connection point 20, a section 28 of riser duct 22. In the case of the tower upper section, the riser duct sections have a portion of their lengths disposed within the interior of body 35, but have their lower portions located outside the body so that the upper riser duct sections are arranged to mate with the riser duct sections carried by the tower central section immediately therebelow in the manner described above. The upper end of each riser duct upper section is connected within tower body 35 to a corresponding connection point 20.

The body 35 of tower upper section 18 defines therein a buoyancy chamber. This buoyancy chamber is connected to the buoyancy control means previously described. Because of the substantially greater internal volume of body 35, it is apparent that the tower upper section is arranged to provide, in the assembled tower, substantially greater positive buoyancy than can be provided by any one of the tower central sections having buoyancy chambers therein.

Figure 6:
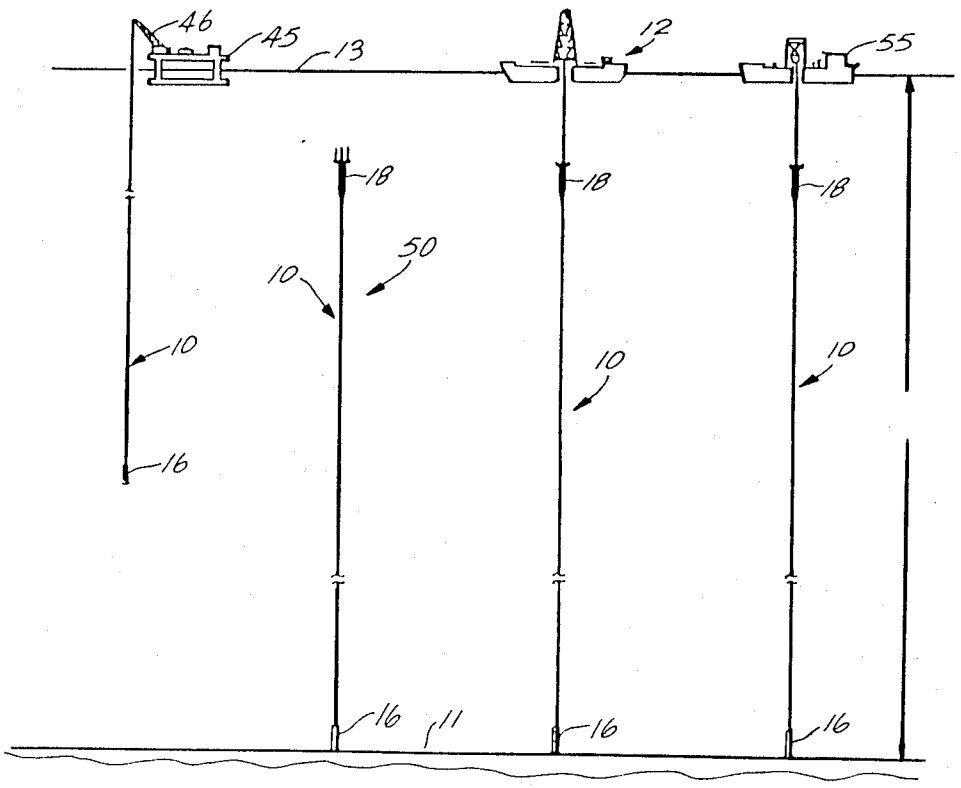
FIG. 6 is a simplified elevation view showing various stages of the construction and use of the tower structure.

FIG. 6 illustrates the installation, completed (free standing), drilled, and produced stages of tower 10 in water having a depth in the range of from 2,000 to 10,000 feet (606–3030 meters). Preferably, the installation of tower 10 is carried out by use of a floating derrick barge 45. However, before arrival of the derrick barge at the intended site of the tower, the sea floor immediately below the installation site is prepared by the use of a floating drilling platform such as a dynamically positioned drillship 12. Preparation of the ocean floor to receive tower 10 may include the drilling of a hole of desired depth and diameter into the ocean floor. The hole as so drilled preferably has a diameter at its upper end which is less than the diameter of the circle associated with the location of the lower ends of riser ducts 22 at tower base structure 21. This hole is drilled through a guide structure which is placed permanently on the ocean floor. The guide includes an upwardly-open funnel type structure having a diameter at its lower end somewhat larger, but not much larger, than the diameter of tower base structure 21. The desired hole is drilled centrally through this funnel-type structure. When the hole has been drilled to the desired depth into a stable geological formation below the ocean floor, the hole is filled with a slow setting grout or cement.

Derrick barge 46 or the like (e.g., a semi-submersible construction platform as shown in FIG. 11) is then brought into position over the grout-filled hole for use in assembling and lowering the tower structure to the ocean floor. The tower lower section 16 is floated in a horizontal attitude to the desired offshore location, and then is ballasted so that it occupies a vertical floating attitude at the ocean surface. The upper end of the tower lower section is suitably guyed to barge 45 to have its upper end held at a predetermined position to the side of the barge within the range of a crane 46 carried by the barge. Then the lowermost tower central section 17 is lowered into registry with and mated to the upper end of the tower lower section, and this assembled pair of tower sections is then controllably lowered, relative to the derrick barge, so that the upper end of the lowermost central section assumes a position above the water surface. Then, in sequence, further tower central sections are mated with and connected to the tower sections previously interconnected. Throughout this process, the assembled tower sections are maintained in a floating vertical attitude by controllably ballasting the assembled tower sections, so that the combination of the several assembled sections has slight net positive or neutral buoyancy with a center of gravity disposed substantially below its center of buoyancy. After connection of the last tower central section into place, the tower upper section 18 is mated to the tower. At this point the tower has been completely assembled, but its lower end is still about 300 feet (90 meters) or so above ocean floor 11.

The assembled tower is rendered negatively buoyant in such a manner that the center of buoyancy of the tower remains a substantial distance above its center of gravity. The negatively buoyant tower is then suitably lowered from the derrick barge into registry with the guide cone previously disposed on the ocean floor at the time the preinstallation preparation operations at the sea floor were performed. As the tower is lowered into the submerged cone at the sea floor, the grouting stub assembly 24 at the lower end of the tower penetrates into the slow setting grout in the prepared hole. The tower is maintained in a negatively buoyant condition and in a vertically erect attitude for such time as is necessary for the slow setting grout to harden around grouting stub assembly 24, thereby to securely anchor the tower to the ocean floor. When the grout has hardened, air is forced into the several buoyancy chambers of the installed tower to render the tower strongly positively buoyant with the center of buoyancy of the installed tower disposed substantially above its center of mass.

In this manner, an unguyed, positively buoyant, compliant tower structure is assembled and installed on the ocean floor. This is the condition of affairs shown at 50 in FIG. 6 in which the upper end of tower 10 is disposed a selected distance, say about 300 feet (90 meters), below water surface 13. At such a depth, the upper end of the tower is essentially isolated from the dynamic effects of wave action on the ocean surface. In this condition the pressure of air contained in the several buoyancy chambers of the tower is at substantially the same pressure as ambient water pressure. Accordingly, the buoyancy chambers present in the tower need be designed only as buoyancy chambers, not as pressure vessels designed to withstand exploding or imploding pressure differentials. The positive buoyancy of the installed tower is greater than the immersed weight of all structures and equipment which may thereafter be landed upon the tower as it is thereafter used in the drilling and production of subsea wells. This positive buoyancy assures that the tower will not be subjected to any net downward load at its upper end so as to balance as a column loaded in compression.

Dynamically positioned drillship 12 is then brought into position over the upper end of the tower, as shown in FIG. 6, for the drilling of that number of subsea wells below the tower as there are connection points 20 defined at the upper end of the tower. These wells are drilled in sequence, using equipment and procedures of the type which have been developed and perfected for use in the drilling of wells in substantially shallower water depths. After the wells have been drilled and completed, a dynamically positioned production vessel 55 is brought into position over the tower for the production of oil or gas from the subsea wells which have been drilled and completed through the tower.

Tower 10 may be installed and used to advantage in waters 2,000 to 10,000 feet (600–3000 meters) or more in depth. The tower can be used for the drilling and production of subsea oil and gas using surface equipment taken from the worldwide inventory of offshore equipment designed for use in substantially shallower depths of water.

Figure 7:
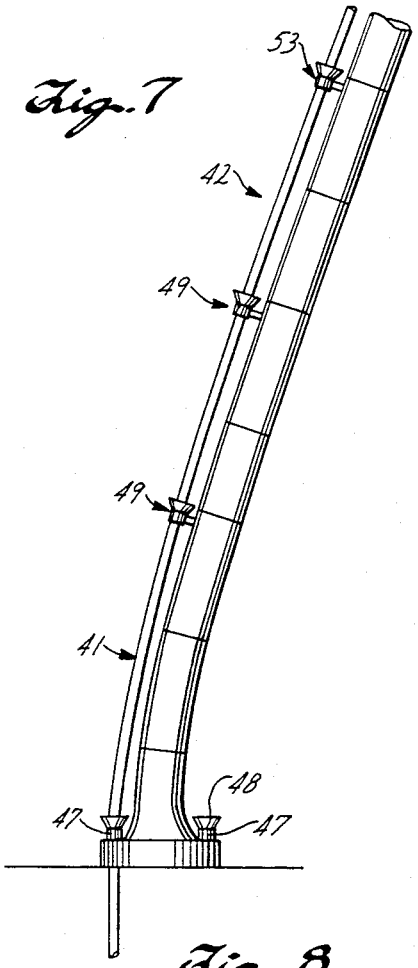
FIG. 7 is a simplified fragmentary elevation view of the lower portion of the tower showing a different arrangement of the connection of the riser ducts to the tower body.
Figure 8:
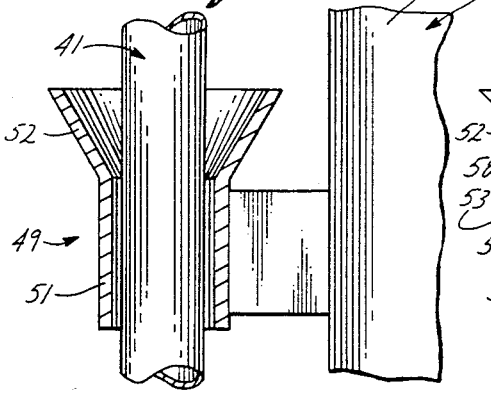
FIG. 8 is an enlarged fragmentary elevation view in cross-section of one form of riser guide structure useful in the arrangement shown in FIG. 7.
Figure 9:
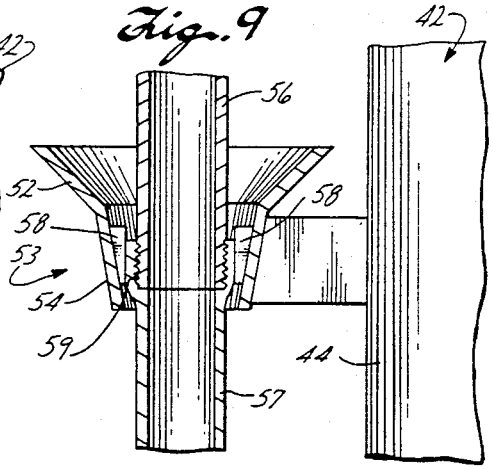
FIG. 9 is an enlarged fragmentary elevation view in cross-section of another form of riser guide structure useful in the arrangement shown in FIG. 7.

FIGS. 7, 8 and 9 illustrate another manner of coupling a riser duct 41 to a tower 42 according to this invention. In tower 10, described above, the several riser ducts 22 are assembled together as the several tower sections are interconnected during assembly of the tower body. In the case of tower 42, however, the riser ducts 41 (only one of which is shown) are installed in the tower after the tower is at least partially assembled. Tower 42 has its sections cooperatively structured and interconnected either in accord with the foregoing description pertinent to tower 10 or in accord with the tower structure modification illustrated in FIG. 10 and described below.

Tower 42 is composed of base, upper and central sections, the base section 43 and some of the central sections 44 being shown in FIG. 7. Base section 43 defines, at selected locations around its axis which correspond to the locations of the connection points 20 in the upper section of the tower, a plurality of receivers 47 for the lower ends of respective ones of risers 41. Each receiver 47 includes an upwardly open, upwardly flared guide bell 48 for cooperation with the lower end of the respective riser for guiding the riser end, as it is lowered along the tower body toward the receiver, into a desired form of engagement between the riser end and the receiver. The riser ends and the receivers are cooperatively structured, as by threads or the like, so that the lower end of each riser can be axially inserted into and securely connected to its respective receiver, and so that the resulting connection can hold the riser end against upward motion when tension is applied to the riser.

Selected ones of the tower central sections 44, but not necessarily each central section, also carry riser guide assemblies 49 which, as shown in FIG. 8, are substantially in the form of tubes 51 having flared upper ends 52; the tubes generally resemble funnels having their axes aligned parallel with the length of the tower. The tubes are fixedly mounted by suitable support arms to the exterior of each adjacent tower section. The guide assemblies are arranged in a pattern about the tower section which corresponds to the pattern of connection points at the upper end of the tower upper section. Each tube 51 has an inner diameter which is a sufficiently small amount greater than the diameter of the adjacent part of a riser duct 41, as installed in the tower, to both loosely cooperate with the adjacent riser and enable the riser portion therebelow to pass through the tube. Each guide assembly 49 functions to hold the riser duct from significant movement laterally relative to the tower body while affording axial movement of the riser in the tube as required in response to bending of the tower body.

If tower 42 is, say 8000 feet (2424 meters) long, it may be desirable to secure the riser ducts to the tower body against axial motion at one or more spaced locations along the lengths of the risers. In such event, one or more riser guide assemblies 53 are provided on the exterior of corresponding tower body sections. As shown in FIG. 9, each guide assembly 53 is generally in the form of a guide assembly 49, but has a gradually tapering lower section 54 (instead of a constant diameter tube 51) below its flared upper end 52. The minimum internal diameter of tapered section 54 preferably is no smaller than any tube 51 below it in the tower.

A coupling, such as threaded coupling 59 shown in FIG. 9, is provided in each riser duct at each guide assembly 53 to facilitate tensioning of the riser therebelow and tensioned connection of the portion of the riser thereabove to the tensioned portion of the riser having its upper end connected to the guide assembly. For example, assume that guide assemblies 53 are disposed in an 8000 foot (2424 meter) long tower at the 4000 foot (1212 meter) level above the lower end of the tower, thereby dividing each riser into upper and lower halves which are affixed to the tower body at their lower 56 and upper 57 ends. At the appropriate time during or after the assembly of the tower, after connection to the tower of the body section carrying guide assemblies 53, the lower half of each riser duct is passed through guide assemblies 53 and 49 into secure connection of its lower end with a corresponding receiver 47. The upper end 57 of each lower half of each riser is then subjected to an upward load to establish a desired tension in the riser lower half, and such upper end is secured to its guide assembly 53 to maintain such tension; such a connection can be established using conventional oil drilling techniques and equipment such as slips 58 shown in FIG. 9. Thereafter, at the appropriate time, the lower end 56 of the upper half of each riser duct can be connected to riser half end 57 and can have its upper end secured under tension in a similar manner to the respective connection point at the upper end of the tower.

If the riser duct mounting arrangement illustrated in FIGS. 7, 8 and 9, for example, is used in a tower according to this invention, the vertical distance between locations at which each riser is fixed to the tower body should be sufficiently great to keep riser duct stresses, due to elongation of the riser relative to the tower body in response to bending of the tower, at acceptable levels. For example, if the centerline of a riser duct is 8 feet (2.42 meters) off the centerline of the tower body which is subjected to 6° bending over a 4000 foot (1212 meters) length of riser between fixed points along the riser, the differential elongation of the riser will be 9.6 inches (24.38 centimeters) which can be accommodated over such length of the riser without adverse effect.

It will be appreciated that any tower according to this invention will be subjected to lateral forces in use due to one or more ocean currents flowing past the installed tower. Such forces will cause the tower to bend, i.e., not be truly vertical in use. Such bending loads have been accommodated in prior submerged tower proposals by the use of hinge connections between the tower and its base at the ocean floor; Carden joints or other freely movable joints or connections have been proposed. The disadvantage of a freely movable connection at the lower end of a tower according to this invention would result in very high bending stresses being developed in the risers which extend along the tower to its base and into the ocean floor. To avoid the generation of high bending stresses in the present riser ducts, while also providing accommodation for current loads applied to the tower, a tower of this invention may incorporate a resilient hinge characteristic in its lower portion as shown in FIG. 10.

Figure 10:
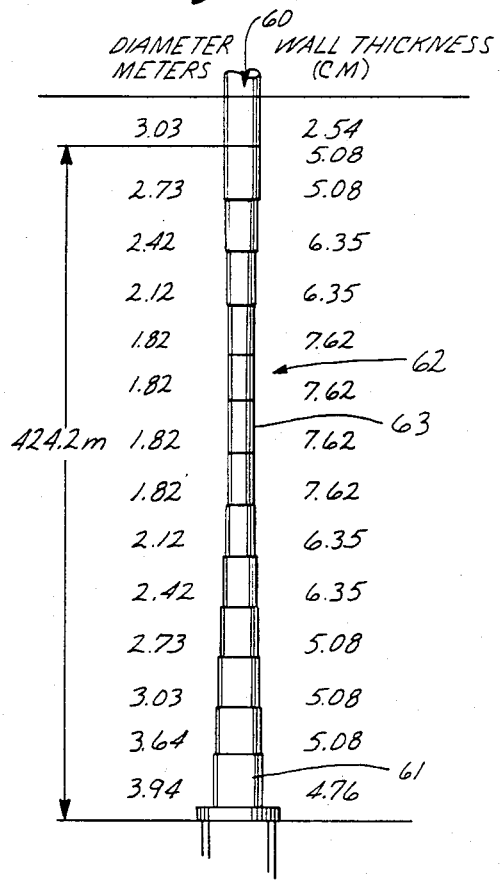
FIG. 10 is an elevation view of a lower portion of a tower structure modified to define a resilient hinge feature adjacent its lower end.

FIG. 10 illustrates a tower 60 according to this invention in which the several body sections immediately above base section 61 define a resilient hinge arrangement 62. These body sections, in one form of the resilient hinge which has been analyzed, may encompass 424.2 meters of the total height of the tower. These body sections differ in diameter so that, proceeding upwardly from base section 61, the tower body progressively diminishes in diameter to a minimum diameter at 63 and then progressively increases to a larger diameter at 64 above which the tower body diameter preferably is constant to the tower upper section. Thus, the tower body proximately above its base section has a reduced bending resistance characteristic in which the transverse moment of inertia of the body first diminishes and then increases. However, because the installed tower has substantial net positive buoyancy, the lower tower sections must be able to withstand the substantial upward loads due to such buoyancy; for this reason and others, it is desired that as the diameters of the tower body sections change, the wall thicknesses of the sections also vary inversely with the diameters. In FIG. 10, data is given for the relation between tower section diameter in meters and wall thickness in centimeters for a resilient hinge arrangement which has been analyzed for a 6000 foot (1818 meter) tower. Such hinge arrangement is composed of 26 tower sections (arranged in groups of 2 sections each), with each section 50 feet (15.15 meters) in length.

Tower 60 has an hourglass configuration over its lowermost extent. Tower 60 relies upon buoyant forces to keep the tower generally vertical in use. The resilient hinge arrangement has the further advantage that the overturning moment at the base of the tower is substantially reduced, thus reducing the complexity and extent of the structure required to secure the tower to the ocean floor. The conductor tubing on the circumference of the base, which extends into the sea floor as a necessary element of an oil or gas well, can provide the necessary piles to hold the base against this reduced overturning moment due to current forces.

A tower structure according to this invention is a long, slender structure. Accordingly, during the assembly procedure described generally above, the assembled sections of the tower form a floating unit which has low waterplane area relative to total volume, and such area is defined by cylindrical elements. As a result the floating unit of assembled tower sections has a low tons-per-inch characteristic, which means that it experiences a substantial increase in draft for each ton of applied load. Such a low tons-per-inch characteristic can be a problem during the tower assembly process which is performed at sea over the location where the tower is to be installed. For example, the low tons-per-inch characteristic means that the unit of assembled sections does not move vertically in response to waves moving past it, and also any miscalculations or unexpected situations concerning the buoyancy of the unit (such as unexpected sea water temperature or salinity at the surface or below) can cause the unit to be more sensitive to applied loads than expected. For these reasons, and also for other reasons which will be made apparent, it is preferred that the tower assembly process (illustrated generally in FIG. 6 and described briefly above) be carried out at a floating work station (such as semi-submersible crane barge 45) in conjunction with an auxiliary floatation structure 70 shown in FIGS. 11–14.

Floatation structure 70 (also called a float) preferably is a positively buoyant, vertically elongate body 71 having a central passage 72 axially through it sized to permit the passage of the tower central and upper sections vertically through it. The body is generally hollow, so as to define internal buoyancy controlling ballast chambers 73, and suitable machinery 74 is provided in the body for pumping sea water into and out of the ballast chambers. Body 71 itself preferably has a relatively low tons-per-inch characteristic so that it is relatively insensitive to heave due to wave action, thereby providing a stable work platform at the upper end of the unit of assembled tower sections. The float body, however, has sufficient positive buoyancy that it can support the assembled tower sections in the event that such unit should become negatively buoyant by a small amount. If, as may be the case, a tower central section has a length of 70 feet (21.2 meters) between flanged upper and lower ends, the float body may have a length of 80 feet (24.24 meters) or so to provide a base for vertical tracks 75 along which holding devices 76 may move. The holding devices (see FIGS. 12, 13 and 14) cooperate between the upper portion of the unit of assembled tower sections and the float body and serve to keep the unit centrally aligned in float passage 72 and to hold the unit vertically relative to the float as the buoyancy of the unit is periodically adjusted and as the unit is lowered relative to the float. The holding devices also enable the unit and the float to be locked together to float as an entity in the event of a storm requiring the unit and the float to be released from barge 45.

Figure 12:
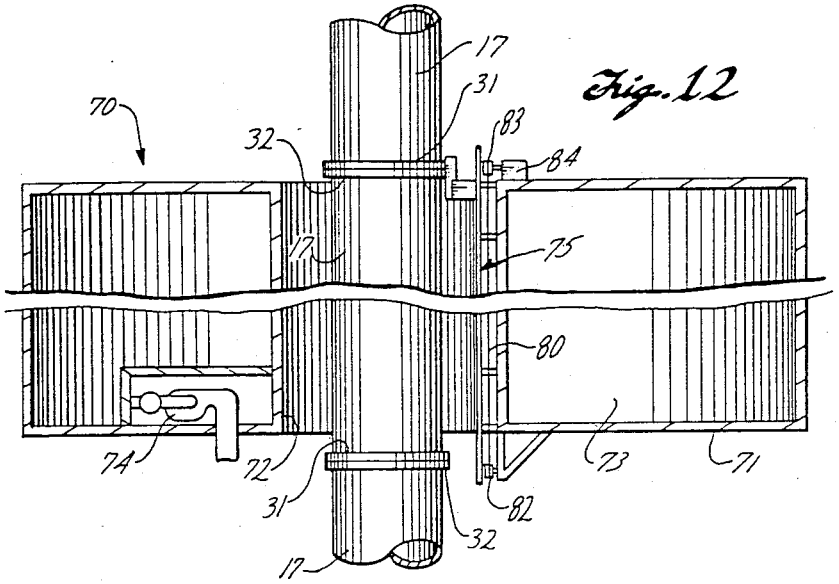
FIG. 12 is a fragmentary elevation view in cross-section showing the general features of the auxiliary floatation structure and the manner of its cooperation with the tower during the tower assembly process.
Figure 13:
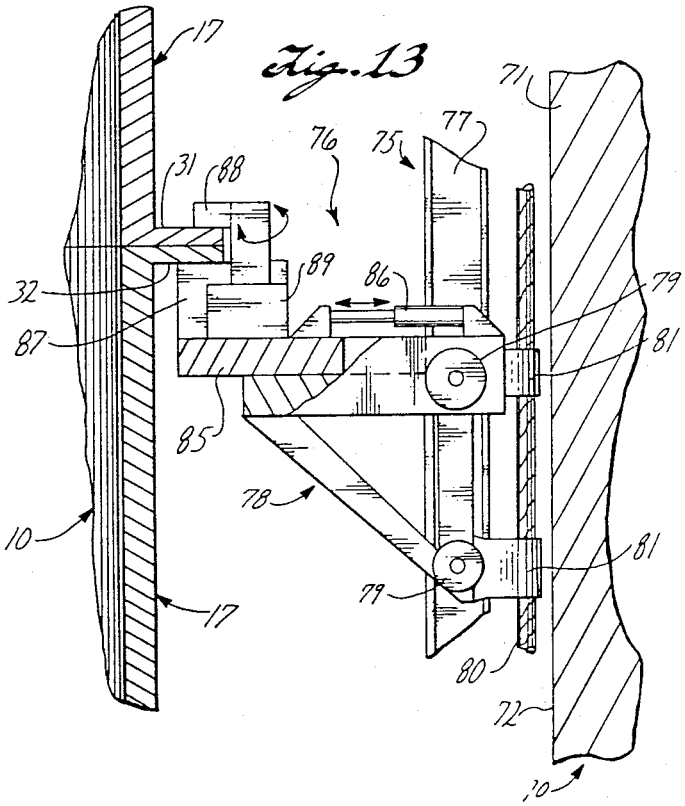
FIG. 13 is a fragmentary enlarged cross-section view of the coupling mechanism provided between the tower and the auxiliary floatation structure.

Preferably there are three sets of vertical tracks 75 and vertically drivable holding devices 76 provided at equally spaced intervals around the circumference of float passage 72; only one of these sets is shown in FIGS. 12–14. Tracks 75 are defined by a pair of laterally spaced vertical rails 77 which define a vertical path of movement for a cart 78 over a distance a selected amount greater than the length of a tower central section, such as section 17. The cart is mounted to the rails via rollers 79 and is driven up and down along the rails by a loop of chain or wire rope 80, to which the cart is connected as at 81, reeved over an idler pulley 82 adjacent the lower end of passage 72 and over a drive wheel 83 located near the upper end of the float body and driven by a suitable motor 84. The cart drive system is positive and can be locked.

The cart has a slide member 85 which is movable radially toward and away from the axis of passage 72 in response to operation of a double-acting linear actuator 86 coupled between the slide and the cart body. The slide carries a support block 87 which is engageable with the underside of the peripheral flange 32 around the upper end of a tower central section 17 and by which the section is connected to the next-adjacent central section of the tower via its lower flange 31. Cooperation of block 87 with a flange 32 holds the unit of assembled tower sections in the float passage from moving downward past the cart. Upward movement of the unit past the cart is prevented by engagement of a hold-down dog 88 with the upper side of a flange 31 mated with flange 32. Dog 88 is rotatable into and out of overlying relation with flange 31 in response to operation of a bidirectional rotary actuator 89 carried on slide 85 near block 87. The slide is movable radially of the passage by an amount adequate to allow mated flanges 31 and 32 to pass downwardly past the cart at the appropriate time.

Preferably, float 70 also includes vertically fixed holding devices near its upper end which are also engageable with a pair of mated flanges 31 and 32 for holding the unit of tower sections in the float in the interval while holding devices 76 are being released from the next lowest set of flanges and raised into engagement with the flanges held by the vertically-fixed holding devices. There can be three vertically-fixed holding devices at equally spaced locations around passage 72 intermediate tracks 75. In this way, a unit of assembled tower sections can be securely held in the float as a further tower section is added to the unit, and as the enlarged unit is then ballasted to have the desired amount of positive buoyancy and as the enlarged unit is lowered through the float so that the upper end of the enlarged unit is positioned closely above the upper end of the float as shown in FIGS. 11 and 12.

If desired, each of tracks 75 and the related cart drive mechanisms, and also the vertically-fixed holding devices if present, can be mounted on rams or the like for movement radially toward and away from the axis of passage 72. In this way the float can be defined to be useful with tower sections of different diameter, such as the tower sections defining the resilient hinge feature shown in FIG. 10.

In the event of a storm during the process of assembling tower 10, e.g., it may become prudent to cast the partially assembled tower and its auxiliary floatation structure off from barge 45. In such event, the float 70 is deballasted to have substantial positive buoyancy, and the partially assembled tower and the float are secured together via holding devices 76, carts 78 and the cart drive mechanisms.

Figure 15:
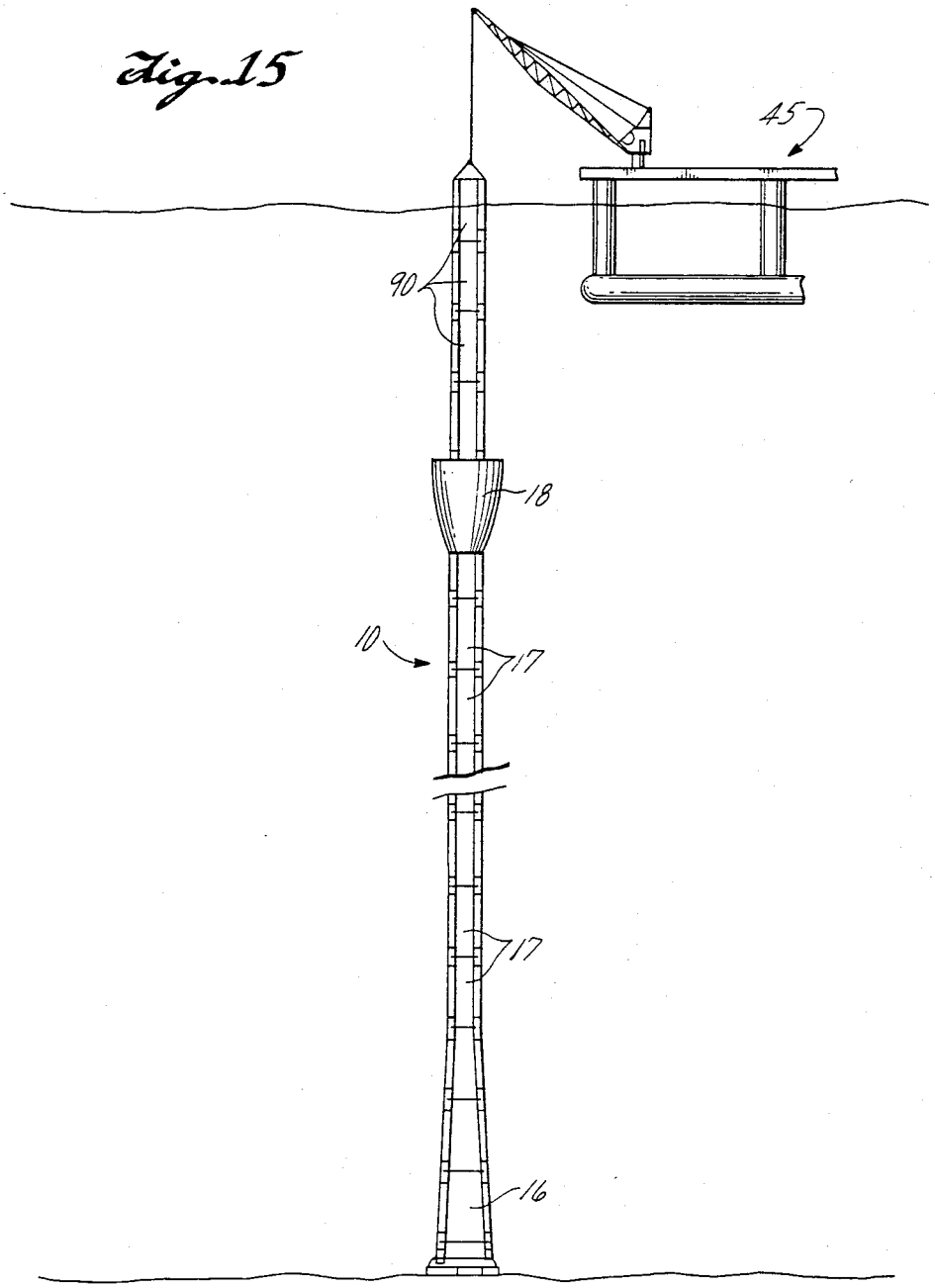
FIG. 15 is an elevation view showing a further step in the process of assembling and installing the tower.

After all sections of the desired tower have been assembled in the desired serial order, the tower will still be disposed above the ocean floor by an amount about equal to the desired submergence of the upper end of the installed tower. To safely lower the assembled tower to the sea floor, and to facilitate further ballasting of the tower as described above, a plurality of temporary lowering spools 90 (see FIG. 15) can be connected serially to the tower upper section. The lowering spools are substantially dummies of the tower central sections, and may be of substantially the same diameter as the central sections (see FIG. 15) or of the same diameter as the upper section. The spools are provided for temporarily establishing a substantial physical connection between the top of the landed tower and the water surface, such as to enable operation of the manipulator shown in FIG. 16 to operate the tower ballast system during the course of rendering the tower negatively buoyant and then finally strongly positively buoyant. The connection of the lowermost lowering spool to the upper end of the tower preferably is remotely releasable, as by use of explosive bolts to define such connection.

It was earlier noted that at least some of the bodies 26 of the tower central section 17 are arranged to define airtight buoyancy chambers which are controllably ballasted during serial interconnection of the tower sections and thereafter to impart desired conditions of buoyancy to the assembled sections. While the compressed air for use in operating such a ballast system can be supplied to the several tower buoyancy chambers by ducting installed within the interior of the tower, it may be more convenient to use an external air supply system 93 of the character shown in FIG. 17 in combination with an external submersible manipulator 94 as shown in FIGS. 16 and 18.

Where an external compressed air supply system and manipulator are used in conjunction with the buoyancy chambers of the tower, the use of temporary lowering spools 90 is especially advantageous; such spools are not disconnected from the installed tower until the final buoyancy condition of the tower has been established.

Figure 17:
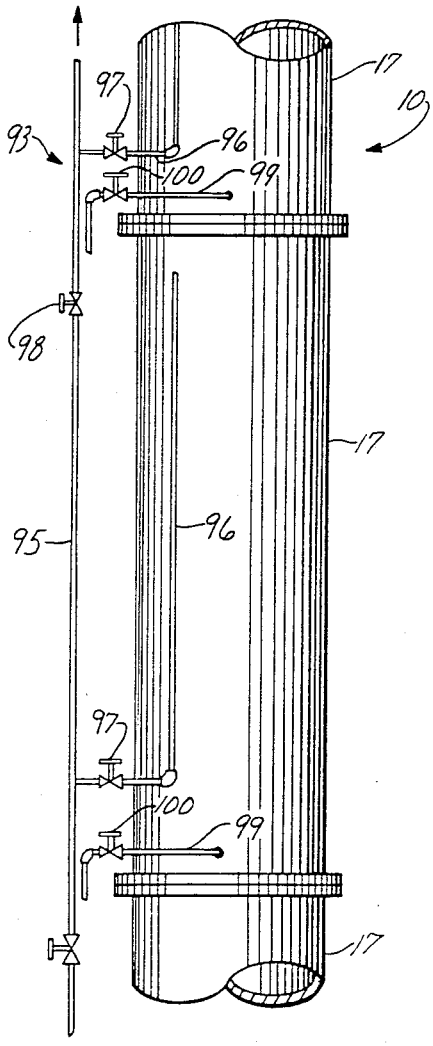
FIG. 17 is a schematic representation of a ballast-deballast system which is useful with the manipulator apparatus shown in FIG. 16.

As shown in FIG. 17, an external air supply system includes a single compressed air and vent line 95 extending along the exterior of the tower over the length of the tower extending to the lowermost internal buoyancy chamber. Near the lower end of each tower section defining a buoyancy chamber, a branch air line 96 extends from main line 95 into the adjacent chamber via a control valve 97 located outside the chamber in a predetermined position. An isolation valve 98 is located in the main line a selected distance below each branch line 96. Inside each chamber, each branch line extends upwardly to a discharge end located closely adjacent to the closed upper end of the chamber. Also, each chamber is equipped adjacent its lower end with a water flood and discharge line 99 controlled by a valve 100 located outside the chamber. Valves 97, 98 and 100 for all of the chambers are vertically aligned with each other on the exterior of the tower, and the valves for one chamber are disposed in a predetermined pattern which is repeated in the valve patterns for all other chambers. Each valve has a rotary actuator which is especially configured to be engaged and operated by a respective operating head on manipulator 94.

Figure 16:
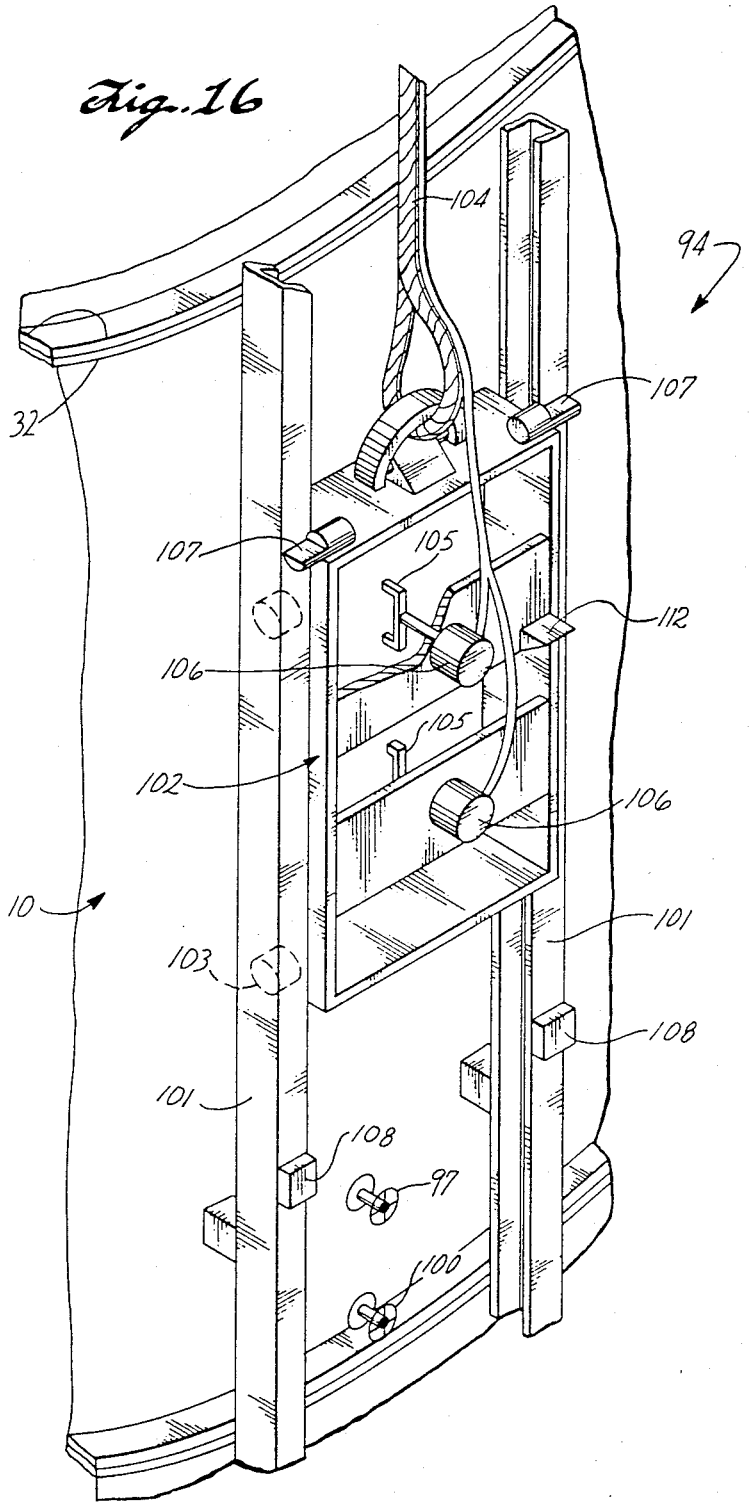
FIG. 16 is a simplified representation of a manipulator apparatus useful in adjusting the buoyancy of the assembled tower sections during the process of assembling and installing the tower.
Figure 18:
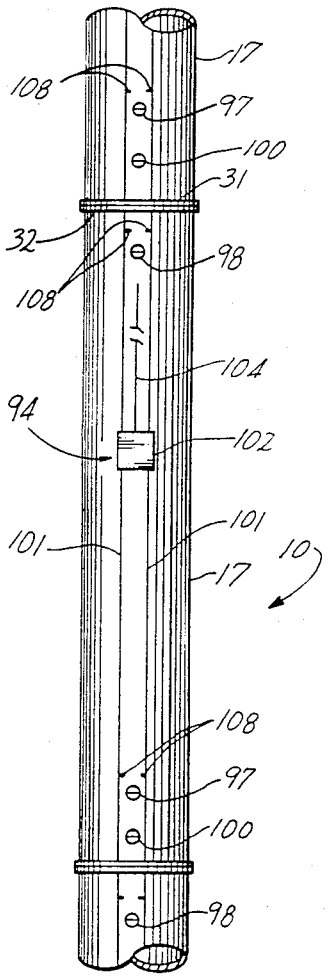
FIG. 18 is a fragmentary elevation view of a portion of a tower equipped with the manipulator and ballast-deballast arrangements shown in FIGS. 16 and 17.

As shown in FIGS. 16 and 18, a pair of light-weight, nonstructural rails 101 are mounted to the exterior of the tower and extend upwardly along the tower from adjacent the lowermost set of valves 97, 98, 100 to the top of the tower and also along the lowering spools, if used. The rails are nonstructural in that their presence is not relied upon to define any of the strength or structural integrity of the tower. The rails are located on either side of the line of valves 97, 98, 100, and provide a track for guiding vertical movement of manipulator 94. The manipulator is provided as a cart-like assembly 102 which is held captive between the rails by rollers 103. Cart 102 is negatively buoyant so that it is urged downwardly by gravity along the rails; the cart is connected to the lower end of a power, control, and hoist cable assembly 104 which extends up the tower to a suitable winch mechanism located on barge 45. The cart carries three rotary actuator heads 105, one for each of valves 97, 98 and 100 (only two of these heads are shown in FIG. 16), in the same pattern on the cart as is defined by the relative positions of each set of valves 97, 98, 100. Each actuator head 105 is connected to a suitable actuator drive mechanism 106 operable to turn the corresponding head in either direction. The actuator drives may be electrical mechanisms powered by power supplied via cable 104 and controlled by suitable control signals supplied via the cable to a suitable control circuit carried by the cart.

Cart 102 can be located at a desired position adjacent each set of valves 97, 98, 100 by cooperation of a pair of retractable detent dogs 107 carried by the cart with position stop members 108 carried by rails 101. The dogs can be turned between stop-engaging and stop-clearing positions by a suitable rotary actuator (not shown) located on the cart and powered and controlled in the same manner as actuators 106. In this way, the manipulator can be precisely positioned adjacent each set of valves along the tower so that the several actuator heads register with their respective valve actuators for operation of the valves in response to operation of actuator mechanisms 106.

As each tower section is added to the tower during the assembly process, main air line 95 is extended and connected to a compressed air supply line 109 which is, in turn, connected to an air compressor 110 aboard barge 45 (see FIG. 11) or to atmosphere, as appropriate at any time.

As set forth above, adjustment of the buoyancy of all interconnected tower sections is required during the assembly and lowering of the tower, and during and after the course of securing the tower to the ocean floor. All necessary adjustments to the buoyancy of the tower can be made readily and safely by manipulator 94 and air supply and vent system 93. To increase the buoyancy of a desired tower section, the manipulator is lowered along rails 101 until it is positioned correctly by dogs 107 and stops 108 adjacent the valves for that tower section. Main tower air line 95 is connected to compressor 110, all isolation valves 98 in line 95 above the tower section of interest being open and the isolation valve for the section of interest being closed. Valves 97 and 100 of the section of interest are opened so air can flow into the section buoyancy chamber through branch line 96 and so water in the chamber can be forced out via line 99. When sufficient water has flowed out of the chamber, valves 97 and 100 are closed; the interior of the adjacent buoyancy chamber is then pressurized to or substantially to ambient pressure conditions. On the other hand, if the buoyancy of a tower section is to be reduced, main tower air line 95 is vented to atmosphere so that similar operation of valves 97 and 100 results in water being forced by ambient pressure into the chamber with air being expressed from the top of the chamber via branch line 96 and line 95; if necessary, main line 95 can be connected to the suction side of compressor 110 to create a reduced pressure in line 95 to assist flooding of a chamber.

If desired, lights and a television camera can be mounted to manipulator cart 102, as by way of bracket 112, to enable visual monitoring of the operation of the manipulator aboard barge 45.

Workers skilled in the art to which this invention pertains will recognize that the invention has been described above with reference to a presently preferred embodiment of the invention. This embodiment has been described by way of example and illustration, not as as an exhaustive catalog of all forms which the structural, and procedural aspects of this invention may take. Accordingly, the preceding description should not be interpreted as setting forth all forms of the structural and procedural aspects of this invention. The preceding description should not be interpreted to restrict the fair scope of the following claims.

What is claimed is:

1. Apparatus useful for defining at an offshore location in an ocean and the like in water of substantial depth a submerged installation providing a connection point for the drilling of a subsea hydrocarbons well by use of drilling equipment normally useful only in waters of substantially shallower depth, the finished installation comprising an elongate, slender, unguyed, positively buoyant erect tower structure extending from a lower end at the ocean floor to an upper end disposed at a selected depth below the water surface, the apparatus comprising a. a tubular tower base section defining at a lower end thereof means adapted for connecting the section directly to the ocean floor and for holding the section from upward movement when subjected to substantial upwardly directed force, the base section having an upper end adapted to mate coaxially with and be secured to a lower end of one of a plurality of tubular tower central sections, b. a tubular tower upper section having a lower end adapted to mate coaxially with and be secured to an upper end of a tubular tower central section and having an upper end defining at least one connection point for the drilling of a subsea hydrocarbons well, the connection point being arranged for access thereto and for connection of selected equipment thereto from above, c. a plurality of tubular tower central sections each adapted at upper and lower ends thereof to mate coaxially with and to be secured to the lower and upper ends of others of the central sections or the upper end of the base section or the lower end of the upper section, as appropriate, the central sections being sufficient in number and aggregate length that when the central sections are connected in series between the base and upper sections there results a tower structure having a length equal to the distance between the selected depth and the ocean floor at said offshore location, d. buoyancy means within the upper section and at least some of the other tower sections operable for controlling the buoyancy of the corresponding tower section, e. whereby, upon serial interconnection of all of the tower sections and connection of the lower section to the ocean floor, there results a submerged tower as aforesaid, and f. at least one tubular drilling riser duct carried by the tower in a selected position relative to the tower and extending along the entire length of the tower, each duct being coupled to the tower at selected locations therealong to be secure from significant lateral movement relative to the tower, there being the same number of riser ducts as there are drilling connection points defined at the upper end of the tower upper section, the ducts being connected at their upper ends to the respective drilling connection points.

2. Apparatus according to claim 1 wherein the buoyancy means includes means for varying the amount of positive buoyancy of more than one of at least some of the tower sections with which the buoyancy means is associated.

3. Apparatus according to claim 1 wherein the buoyancy means includes means for introducing air into the tower sections with which it is associated and for maintaining air pressure in at least some of the tower sections at a pressure substantially equal to the ambient pressure outside the tower section.

4. Apparatus according to claim 1 wherein the riser ducts are disposed externally of the tower central sections and at least partially externally of the tower upper and lower sections.

5. Apparatus according to claim 4 wherein each riser duct is defined by a plurality of duct sections, there being one section of each drilling riser duct for each tower section, each duct section being carried by the corresponding tower section for mating at at least one end thereof with an adjacent end of an adjacent section of the corresponding drilling riser duct upon mating of the related tower section with another tower section.

6. Apparatus according to claim 5 wherein the drilling riser duct sections associated with the tower central sections include connection means for interconnecting the duct sections with duct sections associated with an adjacent tower section, the connection means affording limited axial movement between interconnected duct sections.

7. Apparatus according to claim 5 including connection means for connecting the drilling riser duct sections to the corresponding tower sections, the connection means securing the duct sections from lateral movement while affording limited axial movement relative to the corresponding tower sections.

8. Apparatus according to claim 1 wherein the tower lower section includes means at the lower end thereof adapting the section to be cemented to the ocean floor.

9. Apparatus according to claim 1 wherein the aggregate length of all of the tower sections is approximately 300 feet (90 meters) less than the water depth at said offshore location.

10. Apparatus according to claim 1 wherein the drilling riser ducts are under tension between lower ends thereof connected to the tower base section and upper ends thereof connected to the tower upper section, and including riser guide assemblies carried by selected ones of the tower sections externally thereof loosely cooperating with the riser ducts for constraining the riser ducts from significant lateral movement relative to the respective tower sections while affording axial motion of the riser ducts relative to the respective tower section.

11. Apparatus according to claim 10 wherein at least one of the riser guide assemblies for each riser duct, at a location along the riser duct intermediate its upper and lower ends, is structured in cooperation with the structure of the riser duct for holding the riser duct secure from axial motion relative to the respective tower section and for providing a support relative to which the riser duct therebelow may be subjected to tension.

12. Apparatus according to claim 1 wherein the tower central sections arranged for assembly into the tower structure proximately above the base section are cooperatively arranged to define a resilient hinge section of the tower structure in which, proceeding upwardly along the tower structure from the lower end to the upper end of the hinge section, the tower sections are first of progressively decreasing diameter and then of progressively increasing diameter.

13. Apparatus according to claim 12 wherein, throughout the tower hinge section, the wall thicknesses of the several tower central sections are inversely related to the diameters of the central sections.

14. Apparatus according to claim 1 wherein the tower central sections defining a selected portion of the length of the tower structure proximately adjacent the base section are cooperatively related in structure and dimension to cause the tower structure centrally of such selected portion to have a reduced bending resistance characteristic, which characteristic progressively increases proceeding in opposite directions along such selected portion of the tower structure.

15. Apparatus according to claim 1 further comprising an auxiliary floatation structure useful in the serial interconnection of the several tower sections to define the tower structure, the floatation structure having substantial positive buoyancy and including holder means releasably engageable with selected portions of vertically disposed interconnected tower sections for holding such interconnected tower sections from movement vertically relative to the floatation structure, and drive means for controllably moving the holder means vertically relative to the floatation structure.

16. Apparatus according to claim 15 wherein the auxiliary floatation structure is substantially annular and is arranged for interconnection of the tower sections and for movement of the interconnected sections therethrough.

17. Apparatus according to claim 15 including ballast means operable for controllably varying the positive buoyancy of the auxiliary floatation structure.

18. Apparatus according to claim 2 wherein the means for varying the amount of positive buoyancy comprises a main air flow duct extending along the length of the tower from the top thereof to the lowermost tower section which is to have its buoyancy varied, a valved branch air flow line from the main line into each section which is to have its buoyancy varied, each branch line having an open end adjacent the top of the interior of the respective tower section, and a valved water flow line communicating from the lower interior portion of each respective tower section to the exterior thereof, the main air flow line being connectible alternately to a source of compressed air and to either a source of air at subatmospheric pressure or to atmosphere.

19. Apparatus according to claim 18 wherein the valves for each branch air flow line and each water flow line are operable from the exterior of the respective tower sections.

20. Apparatus according to claim 19 wherein the valves associated with each tower section are disposed in the same relative positions in a pattern common to all such sections, and the patterns are vertically aligned along the tower, and including a remotely controlled manipulator movable along the tower from pattern to pattern for operating the valves in each pattern in a desired manner.

21. Apparatus according to claim 20 including a vertical guide mounted to the tower along said length for guiding the manipulator vertically along the tower, and releasable stop and detent means cooperable between the manipulator and the guide adjacent each pattern of valves for defining a predetermined position of the manipulator relative to each pattern.

22. A method for assembling and installing a tower structure according to claim 1 comprising the steps of a. providing at the offshore location a floating work station and the several tower sections in the appropriate sequence, b. providing adjacent the work station a positively buoyant auxiliary floatation structure, c. disposing the tower base section in a partially immersed vertical attitude in the ocean adjacent the floatation structure and coupling the base section to the floatation structure for control of further immersion of the base section from the floatation structure, d. adjusting the buoyancy of the base section to have a selected small positive buoyancy and sufficient stability to float vertically, e. lowering from the work station to the upper end of the base section the tower central section to be interconnected to the base section, interconnecting the base and central sections, and adjusting the buoyancy of the interconnected sections so that as a unit they have a selected small positive buoyancy and sufficient stability to float vertically while maintaining the coupling of such unit to the floatation structure, f. adjusting the location of coupling of said unit to the floatation structure from the original location to a higher location associated with the uppermost section of the unit, g. repeating of steps e and f mutatis mutandis with the remaining tower central sections and upper section in sequence and with a plurality of temporary installation sections having a collective length a selected amount greater than said selected depth, whereby the tower structure is assembled in serial order from bottom to top and is progressively lowered toward and into engagement with the ocean floor at the offshore location from the work station, h. upon engagement of the assembled tower structure with the ocean floor, adjusting the buoyancy thereof to be negative but with a center of buoyancy substantially higher in the tower structure than its center of mass, and securing the base section to the ocean floor, i. following securing of the tower structure to the ocean floor, adjusting the buoyancy of the tower structure to be substantially positive with its center of buoyancy substantially higher in the tower structure than its center of mass, and j. disconnecting the temporary installation sections from the tower upper section.

23. The method of claim 22 including the further step of installing the drilling riser ducts in the tower structure following completion of step i of claim 18.

24. The method of claim 23 wherein the step of installing the riser ducts includes the steps of a. passing each desired drilling riser duct from the work station through the respective drilling connection point and through guide structures located at selected points along the tower structure into engagement by the lower end of the riser duct with the tower base section, b. securing the lower end of the riser duct to the base section sufficiently to thereafter withstand tension in the riser duct, c. applying tension of selected amount to the riser duct at least at the respective connection point and securing the riser duct to the respective drilling connection point adequately to maintain such tension in the riser duct.

25. Apparatus for use in drilling subsea hydrocarbon wells in substantial water depths, the apparatus providing a drilling wellhead at a submerged location substantially above an ocean floor and enabling the use of equipment normally useful only in waters of substantially shallower depth, the apparatus comprising an elongate, slender, unguyed, positively buoyant tower structure having a lower end securable to the ocean floor at site at which at least one subsea well is to be drilled and having an upper end disposed a substantial distance above the ocean floor and a selected distance below the water surface, the tower having a center of buoyancy located along its length a substantial distance above its midlength whereby the tower structure stands erect on the ocean floor, and at least one drilling riser duct coupled to the tower structure and extending therealong from the duct lower end disposed in association with the tower structure lower end to a duct upper end at a drilling wellhead associated with the tower structure at the upper end thereof and accessible from above the tower structure for receiving and supporting a blowout preventer and the like for the drilling through the duct of at least one hydrocarbon well in the ocean floor below the tower.

26. Apparatus according to claim 25 wherein the riser duct, is disposed other than coaxially of the tower and is secured from lateral movement relative to the tower yet is afforded limited axial movement relative to the tower.

27. Apparatus according to claim 25 wherein the tower has substantial net positive buoyancy distributed principally along a substantial portion of the upper extent of the tower.

28. Apparatus according to claim 25 including means at the upper end of the tower and accessible from thereabove for guiding equipment lowered to the tower to a selected drilling wellhead.

29. A method for assembling and installing at an offshore location in an ocean and the like in water of substantial depth a submerged installation for the drilling of a subsea hydrocarbons well by use of drilling equipment normally useful only in waters of substantially shallower depth, the finished installation comprising an elongate, slender, unguyed, positively buoyant erect tower structure extending from a lower end at the ocean floor to an upper end disposed at a selected depth below the water surface, the method comprising the steps of a. providing a tubular tower base section which defines at a lower end thereof means adapted for connecting the section to the ocean floor and for holding the section from upward movement when subjected to substantial upwardly directed force and which has an upper end, a tubular tower upper section which has a lower end and an upper end, and a plurality of tubular tower central sections each adapted at upper and lower ends thereof to be secured to the lower and upper ends of others of the central sections or the upper end of the base section or the lower end of the upper section, as appropriate, the central sections being sufficient in number and aggregate length that when the central sections are connected in series between the base and upper sections there results a tower structure having a length equal to the distance between the selected depth and the ocean floor at said offshore location, b. providing at the offshore location a floating work station and the several tower sections in the appropriate sequence, c. providing adjacent the work station a positively buoyant auxiliary floatation structure, d. disposing the tower base section in a partially immersed vertical attitude in the ocean adjacent the floatation structure and coupling the base section to the floatation structure for control of further immersion of the base section from the floatation structure, e. adjusting the buoyancy of the base section to have a selected small positive buoyancy and sufficient stability to float vertically, f. lowering from the work station to the upper end of the base section the tower central section to be interconnected to the base section, interconnecting the base and central sections, and adjusting the buoyancy of the interconnected sections so that as a unit they have a selected small positive buoyancy and sufficient stability to float vertically while maintaining the coupling of such unit to the floatation structure, g. adjusting the location of coupling of said unit to the floatation structure from the original location to a higher location associated with the uppermost section of the unit, h. repeating steps f and g mutatis mutandis with the remaining tower central sections and the upper section in sequence and with a plurality of temporary installation sections having a collective length a selected amount greater than said selected depth, whereby the tower structure is assembled in serial order from bottom to top and is progressively lowered toward and into engagement with the ocean floor at the offshore location from the work station, i. upon engagement of the assembled tower structure with the ocean floor, adjusting the buoyancy thereof to be negative but with a center of buoyancy substantially higher in the tower structure than its center of mass, and securing the base section to the ocean floor, j. following securing of the tower structure to the ocean floor, adjusting the buoyancy of the tower structure to be substantially positive with its center of buoyancy substantially higher in the tower structure than its center of mass, and k. disconnecting the temporary installation sections from the tower upper section.

30. Hydrocarbons, both raw and refined, produced from a subsea hydrocarbons source by use of apparatus according to claim 25.

31. Hydrocarbons, both raw and refined, produced from a subsea hydrocarbons source by use of apparatus installed adjacent the source by practice of the method according to claim 29.

* * * * *

UNITED STATES PATENT AND TRADEMARK OFFICE

CERTIFICATE OF CORRECTION

PATENT NO. : 4,511,287

DATED : April 16, 1985

INVENTOR(S) : Edward E. Horton

It is certified that error appears in the above-identified patent and that said Letters Patent is hereby corrected as shown below:

Column 19, line 63, for "18" read -- 22 --.

Signed and Sealed this

*Seventeenth* Day of *September 1985*

[SEAL]

*Attest:*

DONALD J. QUIGG

*Attesting Officer*

*Commissioner of Patents and Trademarks—Designate*